United States Patent [19]

Kucyk, Jr. et al.

[11] Patent Number: 4,759,161

[45] Date of Patent: Jul. 26, 1988

[54] BREAKAWAY SUPPORT STRUCTURE WITH REPLACEABLE SHEAR CONNECTOR

[76] Inventors: William J. Kucyk, Jr., 1366 Key West, Troy, Mich. 48083; Alan D. Whitefield, P.O. Box 351, Lake Orion, Mich. 48035

[21] Appl. No.: 898,218

[22] Filed: Aug. 20, 1986

[51] Int. Cl.[4] ..... E04C 3/32; E01F 9/01

[52] U.S. Cl. ..... 52/99; 52/296; 404/10

[58] Field of Search ..... 52/98, 99, 726, 294–298; 404/10; 403/2; 256/1, 60

[56] References Cited

U.S. PATENT DOCUMENTS

| | | | |
|---|---|---|---|
| 1,083,120 | 12/1913 | May | 52/301 |
| 2,046,152 | 6/1936 | Dean | 52/301 |
| 2,469,494 | 5/1949 | Bushko | 52/298 |
| 2,748,954 | 6/1956 | Murren | 52/726 |
| 2,945,659 | 7/1960 | McDonald | 52/98 |
| 3,698,144 | 10/1972 | Stratton | 404/10 |
| 4,565,466 | 1/1986 | Daggs et al. | 404/10 |
| 4,610,432 | 9/1986 | Lewis et al. | 52/98 |

FOREIGN PATENT DOCUMENTS

| | | | |
|---|---|---|---|
| 6197 | of 1906 | United Kingdom | 52/295 |

*Primary Examiner*—James L. Ridgill, Jr.
*Attorney, Agent, or Firm*—Robert L. Kelly

[57] ABSTRACT

A breakaway support structure for a sign, light, or mailbox. A foundation post is anchored in the ground and has a projection extending from an upper end. A support post has a sleeve on a lower end which receives the projection. The sleeve and projection are interconnected by at least one linking member which has a preferentially breakable portion. The linking member in one embodiment may be an eyebolt which receives a shear pin. In another embodiment, the projection is a coil spring which is secured on one end to the foundation post and is connected to an annular housing on the lower end of the support post by two spaced fasteners having preferentially breakable portions. In another embodiment, a conventional sign post is retained in a cup-shaped housing that is connected to the projection of the foundation post by at least one linking member which has a preferentially breakable portion.

3 Claims, 3 Drawing Sheets

BREAKAWAY SUPPORT STRUCTURE WITH REPLACEABLE SHEAR CONNECTOR

FIELD OF THE INVENTION

The present invention relates generally to breakaway support structures and more particularly to breakaway support structures having a replaceable connector which shears when the support member is impacted.

BACKGROUND

Breakaway, or knock down, support structures are used to support objects which must be located near a highway and are subject to occasional impacts by motor vehicles. Breakaway support structures are provided so that when the support structure is impacted by a motor vehicle the support structure will yield to limit damage to a vehicle, the support structure and the object carried by the support structure. Such objects may include mail boxes, signs and lights. Breakaway support structures must be strong enough to withstand low level forces from incidental contact or the wind.

Prior breakaway support structures are not generally designed to be reused following impact. After such structures are impacted the entire member must be replaced.

It is one object of the present invention to provide a support structure for objects having a fracturable link, or shear pin, interconnecting the support structure to a foundation member so that impact by a motor vehicle will cause the fracturable member to break thereby limiting damage to the support member and permitting reuse of the support member. The breakaway support structure also minimizes damage to the motor vehicle by reducing the force applied by the motor vehicle prior to the yielding of the support member.

It is an important object of the present invention to provide an interconnection including at least one shearable member which may be simply replaced after impact without having to reexcavate and anchor the support structure in the ground.

It is another object of the invention to provide two elements in the interconnection between the foundation and the support member which may shear upon impact. According to the present invention, one of the two shearable elements is preferably fracturable from any direction upon application of sufficient lateral force.

Another feature of the present invention is the use of a flexible meaber such as a cable which limits movement of the support structure away from its foundation.

Another aspect of the invention is to provide a breakaway support structure having interengaging portions on the foundation member and support member which align the support member with the foundation member.

SUMMARY OF THE INVENTION

The present invention relates to a breakaway support structure for objects, such as mail boxes, which are located adjacent to a road. The breakaway support structure includes a foundation post which is anchored in the ground. A support post holds the object to be supported on its upper end. The support post also has a rigid sleeve connected to the lower end of the support post which is adapted to receive a projection extending upwardly from the foundation post into the sleeve. A preferentially breakable link, or shear pin, interconnects the projection to the sleeve so that the support post will break free of the foundation post upon application of a force against the side of the support post.

A cable is provided to limit movement of the support post from the foundation post. The cable includes loops on opposite ends which are secured to the projection and the shear pin or sleeve. The shear pin extends through the eye of an eyebolt which forms part of the projection. The eyebolt provides a second potential preferential breakage location between the curved part of the eyebolt and the shank. The eyebolt presents a fracture point which is vulnerable to the application of force from any lateral direction.

The sleeve preferably includes slots that receive a portion of the projection to aid in aligning the support post with the foundation post.

In a preferred embodiment of the invention, the breakaway support structure for supporting an object, such as a mail box, includes a foundation post and a support post which are linked together within a sleeve by an eyebolt connected to a bracket and a shear pin. The foundation post is anchored in concrete and includes a U-shaped bracket on its upper end which supports an eyebolt having an eye located above the bracket. The bracket is received within a sleeve which has holes extending through spaced walls which are aligned perpendicular to the longitudinal axis of the support post. The shear pin fastener has a weakened portion and extends through the holes in the sleeve and the eye of the eyebolt so that the shear pin or eyebolt will fracture at the weakened portion upon application of a predetermined lateral load on the support post.

In an alternative embodiment of the present invention, the projection comprises a coil spring which is disposed partially within an axial opening formed in the foundation post. The coil spring is also partially received within an annular housing located on the lower end of the support post. The support post is connected to the coil spring by means of first and second fasteners having weakened portions which extend through first and second holes formed in the annular housing. The fasteners extend through the coil spring and are axially adjacent spaced portions of the coil spring. The coil spring is a resilient projection which yields elastically upon application of low level lateral loads. However, substantial lateral loads applied to the support post are transmitted through the coil spring to at least one of the fasteners resulting in the fracture of one of the fasteners at their weakened portion.

The annular housing preferably includes slots formed in the bottom edge. Tabs extend upwardly from the edge of the axial opening of the foundation post in locations corresponding to the locations of the slots formed in the annular housing. The tabs and slots are engaged to prevent rotation of the support post on the foundation post.

The breakaway support structure of the present invention is also adaptable for use in supporting a sign having a standard sign post. The sign post is received in a cup-shaped housing having a cap on its upper end. The cap includes an opening corresponding in shape to the cross-section of the support post. The support post is connected to an eyebolt by means of a shear pin type fastener. Another fastener is provided to connect the support post to the cup shaped housing to maintain the cup shaped housing upon the support post after the shear pin fastener or eyebolt fractures upon application of a predetermined load.

Briefly, the objects of the invention include the provision of a breakaway support structure which is easily replaced by repositioning the support post upon the foundation post and replacing one or more easily accessible fracturable members such as an eyebolt or a shear pin.

These and other objects and advantages of the present invention will be better understood upon study of the attached drawings in view of the following detailed description and claims.

DETAILED DESCRIPTION

Figure 1:
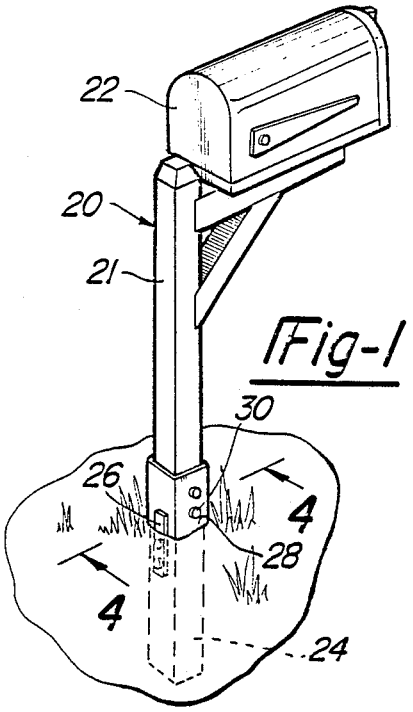
FIG. 1 is a perspective view of the breakaway support structure supporting a mail box.

Referring now to the drawings, and in particular FIGS. 1-5, a preferred embodiment of the breakaway support structure 20 of the present invention is illustrated. The breakaway support structure 20 includes a support post 21 for an object 22, such as a mail box. The support post 21 is secured to a foundation post 24 which is anchored in the ground. The foundation post 24 is connected to the support post 21 by means of a bracket 26 and a sleeve 28, or housing, which are held together by a shear pin fastener 30. The bracket 26 extends upwardly from the upper end of the foundation post 24 and into the sleeve 28 which extends from the lower end of the support post 21.

Figure 2:
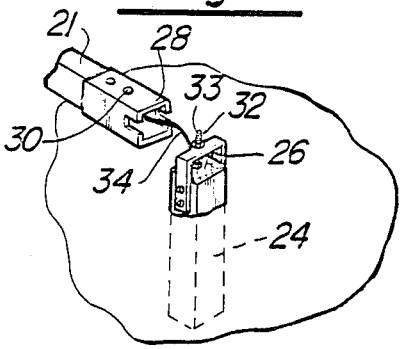
FIG. 2 is a fragmentary perspective view showing the breakaway support structure after impact.

The breakaway mechanism will be more particularly described with reference to FIGS. 2-5. In FIG. 2, the support post is shown removed from the foundation post 24 as would be expected after an impact upon the support post by a motor vehicle. The bracket 26 remains attached to the foundation post 24. An eyebolt 32 is secured to the bracket 26 the foundation post 24 and support post 21 are held in proximity to one another by a cable 34 so that the support post 21 does not become a projectile after it breaks away from the foundation post 21.

Figure 3:
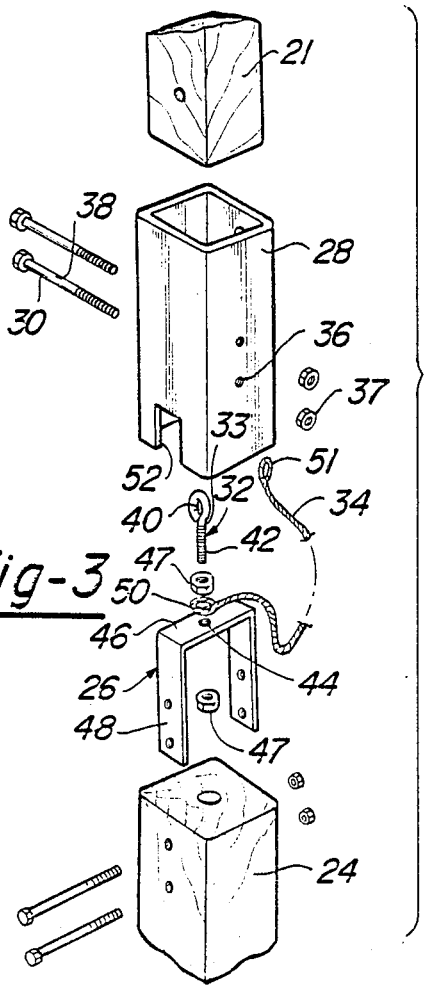
FIG. 3 is a fragmentary exploded perspective view showing the arrangement and assembly of the breakaway support structure made according to one illustrated embodiment.
Figure 5:
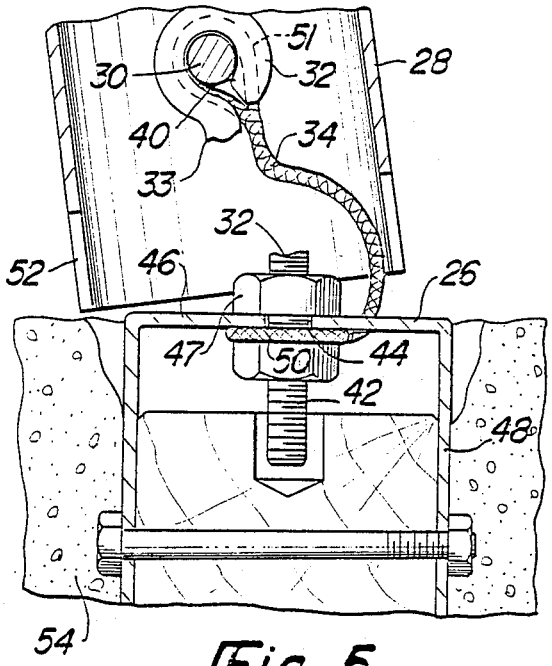
FIG. 5 is a fragmentary cross-sectional view showing the breakaway support structure immediately after impact.

Referring now to FIG. 3, the shear pin fastener 30 is shown to extend through holes 36 formed on opposite sides of the sleeve 28. The shear pin fastener 30 is retained in the sleeve 28 by means of a nut 37. The shear pin fastener 30 includes an annular groove 38 which forms a weak point on the shear pin fastener to cause the fastener to break at the location of the annular groove 38. Provision of the annular groove 38 facilitates providing a shear pin fastener 30 that will break at a rated force level. A second fracturable member is provided by means of the eyebolt 32. The eyebolt 32 includes an eye 40 comprising an opening defined by a circularly curved portion of the eyebolt which is contiguous with a shaft 42. The shaft 42 is a straight threaded member which is adapted to be received in a hole 44 formed in the base 46 of the bracket 26. The eyebolt 32 is maintained on the base 46 by means of nuts 47. An inherent stress point 33 on the eyebolt 32 is formed at the intersection of the shaft 42 and the circular portion defined in the eye 40. Referring to FIGS. 2 and 5, upon impact from any direction, the eye 40 of the eyebolt is subject to breakage from the shaft 42. The eyebolt thereby provides an omni-direction fracturable member. The base 46 of the bracket 26 extends horizontally between two vertical legs 48 that are located on opposite sides of the foundation post 24. The legs 48 are fastened to the foundation post 24 by means of fasteners.

Figure 4:
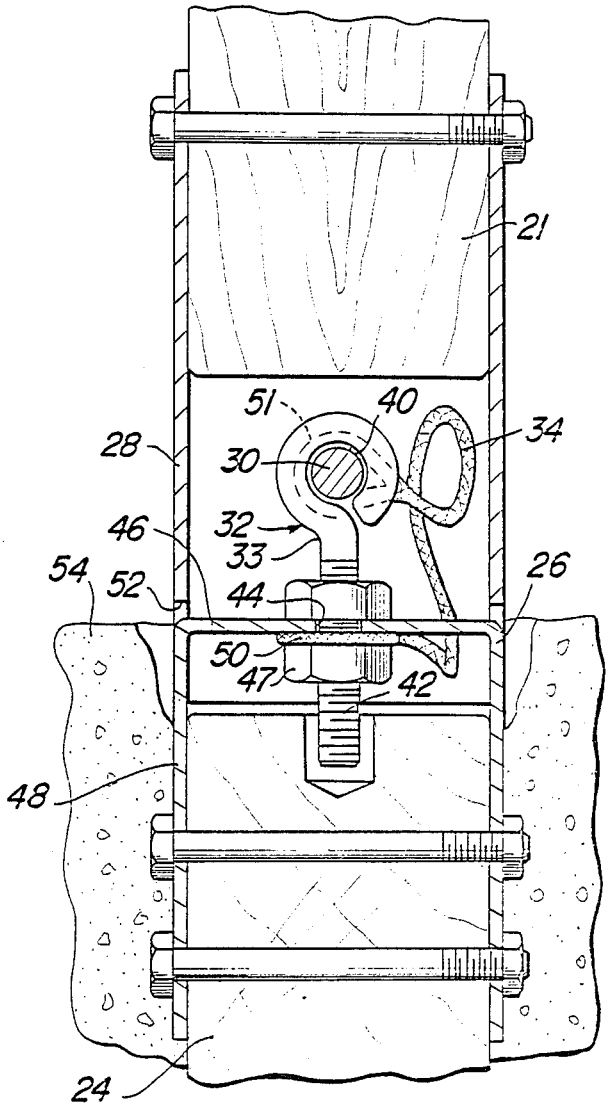
FIG. 4 is a cross-sectional view of the breakaway support structure as assembled taken along the line 4—4 in FIG. 1.

The cable 34 is provided to prevent the support post 21 from completely separating from the foundation post 24 and becoming a projectile upon impact. The cable 26 is normally stored within the opening formed in the sleeve 28 and is attached by means of two loops 50, 51 to the shaft 42 of the eyebolt 32 and to the shear pin fastener 30 on its other end. As shown in FIGS. 4 and 5, the foundation post is preferably anchored in the ground by means of a poured concrete body 54.

Figure 6:
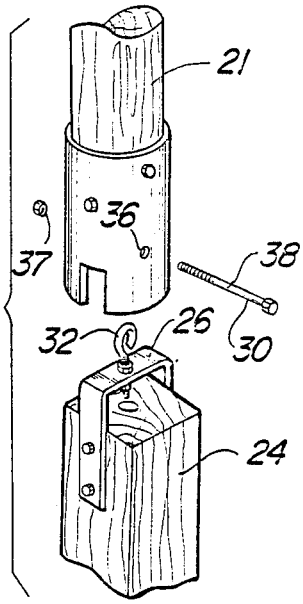
FIG. 6 is a partially explosed fragmentary perspective view showing a cylindrical support post.
Figure 7:
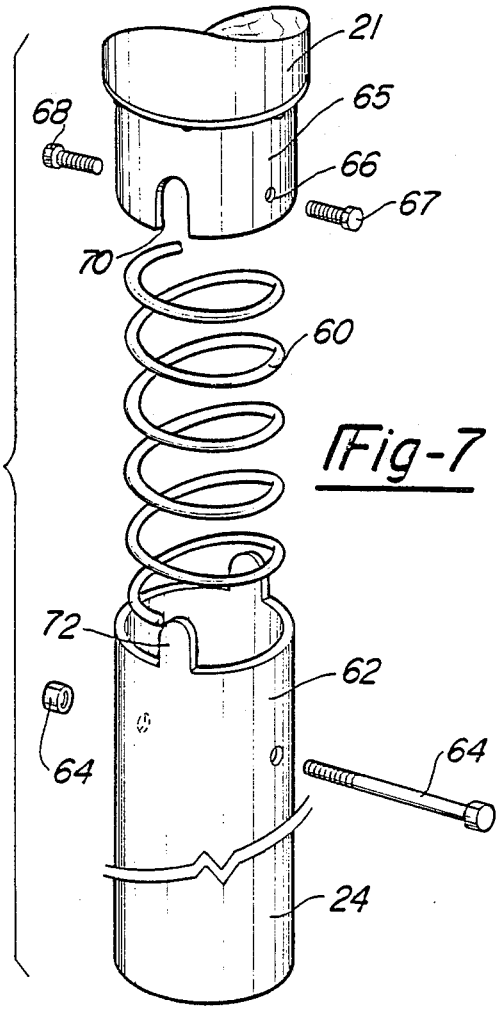
FIG. 7 is a fragmentary exploded perspective view of a breakaway support structure including a coil spring interconnection.

Referring now to FIG. 6, an alternative embodiment is shown wherein the support post 21 is cylindrical in shape for aesthetic purposes. If the support post 21 is cylindrical it is advantageous to provide a cylindrical sleeve 28. However, the other parts of the breakaway support structure are essentially the same.

Another illustrated embodiment is provided in FIGS. 7-10 wherein a coil spring 60 is received in an annular portion 62 of the foundation post 24. The annular portion 62 may be one end of a tubular foundation post 24 or may be an annular ring upstanding from the upper end of a solid foundation post. The coil spring 60 is preferably anchored within the annular portion 62 by means of an anchor nut and bolt 64 which retain the coil spring in the desired location in the foundation post 24. Anchor nut and bolt 64 also prevent the spring 60 from being pulled out of the top end of the annular portion 62 upon impact. The portion of the spring 60 not contained within the annular portion 62 is received within an annular housing 65 that is secured to the support post 21. The annular housing 65 includes threaded hole 66 on opposite ends which receive shear pin fasteners 67, 68 in diametrically opposed sides thereof.

Slots 70 are preferably provided at two locations on the lower end of the annular housing 65 for receiving correspondingly located tabs 72 which extend upwardly from the annular portion 62. The tabs 72 are received in the slots 70 to prevent rotation of the support post 21 on the foundation post 24.

Figure 8:
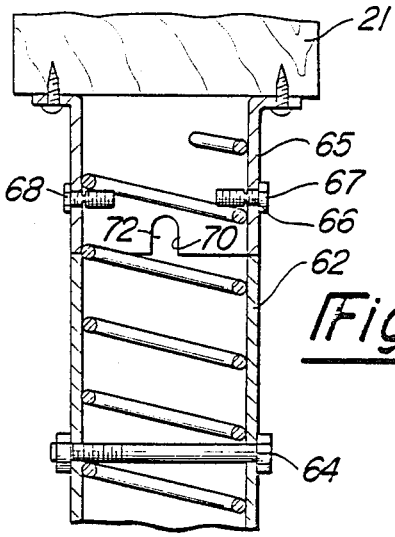
FIG. 8 is a cross-sectional view of the embodiment shown in FIG. 7 fully assembled.

Referring to FIG. 8, the coil spring embodiment is shown assembled prior to impact wherein the lower end of the spring 60 is in engagement with the anchor nut and bolt 64 and the upper end of the spring 60 is in engagement with shear pin fasteners 67, 68 that extend through the threaded hole 66 in the sides of the annular housing 65 to a point located radially inward of the spring 60. The spring 60 is in axial engagement with the shear pin fasteners 67, 68 at spaced locations.

Figure 9:
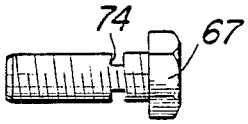
FIG. 9 is a side elevational view of a fastener having a weakened portion which is intended to use in the embodiment of FIGS. 7 and 8.

One of the shear pin fasteners 67 is shown in FIG. 9 to include an annular groove 74. The annular groove 74 provides a weakened portion of the shear pin fastener 67 so that the fastener will break at the annular groove 74 upon exertion of a predetermined force.

Figure 10:
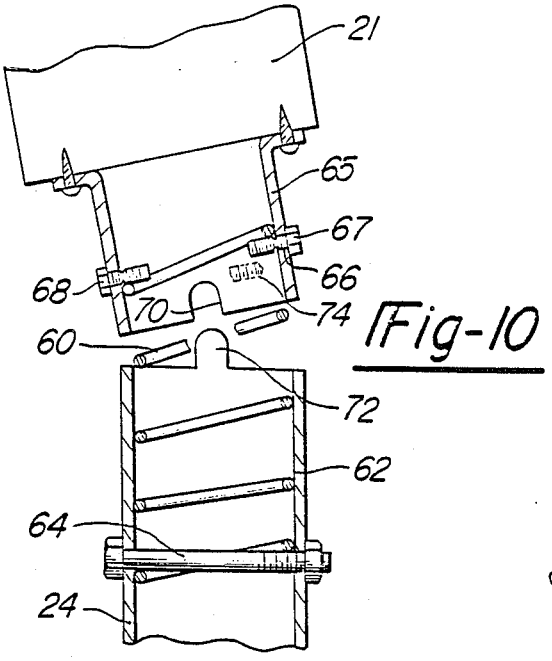
FIG. 10 is a cross-sectional view showing the embodiment of FIGS. 7 and 8 immediately after impact.

Referring to FIG. 10, the coil spring embodiment is shown immediately after impact wherein the coil spring 60 absorbs some of the impact but upon reaching a predetermined level the coil spring 60 is forced against the shear pin fastener 67 with sufficient force to break off the end of the shear pin fastener 67. The annular groove 74 assures a clean break of the shear pin fastener 67 at the desired location.

To replace the support post 21 on the foundation post 24 it is only necessary to remove the broken shear pin fastener 67, 68 and place the annular housing 65 over the upper end of the coil spring 60. After the support post is placed upon the foundation post 24 with the tabs 72 in the slot 70 in the shear pin fastener 67, 68 can be reinserted through the threaded holes 66 to complete the replacement of the support post 21. One advantage provided by the coil spring embodiment is that low force impacts on the support post 21 can be absorbed without breakage of the shear pin fastener 67, 68. Also, the coil spring 60 is not subject to being plasticly deformed by an impact upon the support post 21.

Figure 11:
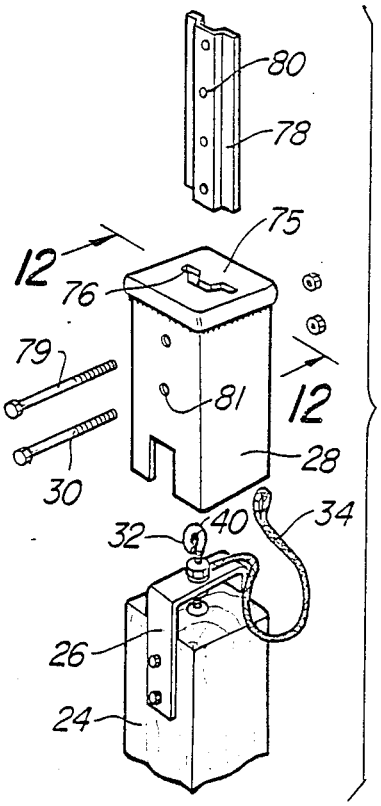
FIG. 11 is a fragmentary exploded perspective view of a sign post breakaway support structure.
Figure 12:
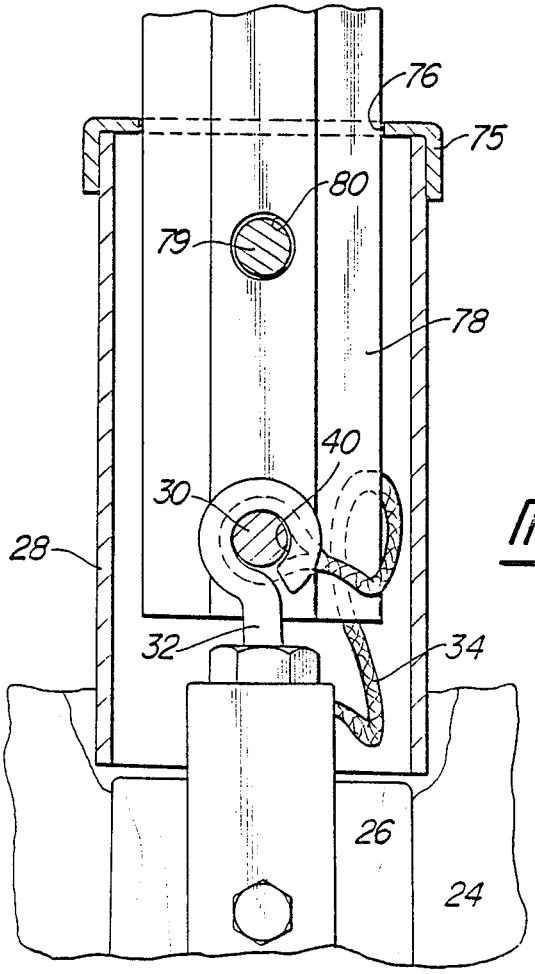
FIG. 12 is a cross-sectional view taken along the line 12—12 in FIG. 11 showing the parts of the sign post embodiment assembled.

Referring now to FIGS. 11 and 12, a breakaway support structure for a highway sign is provided. The sleeve 28, or housing, shown in FIG. 11, is welded on its upper end to a cap 75. The cap 75 includes a cut out 76 comprising an opening shaped to conform to the cross-section of a conventional steel sign post 78. The sign post 78 is retained within the sleeve 28 by a standard fastener 79 and a shear pin fastener 30. The sign post 78 includes a plurality of spaced holes 80 in which the fastener 79 and shear pin fastener 30 are received. The fastener 79 and shear pin fastener 30 also extend through holes 81 formed in the sides of the sleeve 28. The shear pin fastener 30 extends through the eye 40 of the eyebolt 32 to provide an additional shear point. The interconnection between the support post 21 and foundation post 24 may be broken at either the shear pin 30 or the eyebolt 32. The cable 34 is preferably connected to both the eyebolt 32 and the fastener 79. Even if the shear pin fastener 30 breaks, the cable will remain attached to the fastener 79 and the sleeve 28 will remain connected to the sign post 78 since the fastener 79 is not designed to fracture.

Replacement of the sign post 78 on the foundation post 24 is accomplished by simply removing either the broken eyebolt 32 or the broken shear pin fastener 30 and repositioning the sleeve 28 over the bracket 26. The shear pin fastener 30 may then be reattached through the eyebolt 32. The ease of replacing the support post upon the foundation post 24 is the primary object of the present invention since it eliminates the need to dig another hole which must be filled with concrete to establish a firm foundation for the support member.

It is apparent that there has been provided, in accordance with the invention, a breakaway support structure for supporting a mail box, sign, or the like that fully satisfies the objects, aims, and advantages set forth above. While the invention has been described in conjunction with several specific embodiments thereof, there are many alternatives, modifications and variations that will be apparent to those skilled in the art in light of the foregoing description. Accordingly, Applicant intends to include all such alternatives, modifications and variations included within the spirit and broad scope of the appended claims.

I claim:

1. A breakaway support structure for supporting objects such as mailboxes and signs adjacent a road comprising:

a foundation post having a lower end and an upper end, the lower end anchored in concrete;

a U-shaped bracket having a flat base portion extending between two parallel legs, said legs being fastened by fastening means to opposite sides of the upper end of the foundation post with the flat base portion extending across the upper end, the flat base portion being spaced from said upper end;

an eyebolt having an eye on one end formed by an annular bend in the eyebolt, said eyebolt being received in an opening in the flat base portion and being fastened to the base portion with the eye disposed above the flat base portion of the U-shaped bracket;

a support post having a longitudinal axis, the support post comprising an elongated rigid member having an upper end to which an object is secured and a lower end, said lower end having;

a sleeve attached to and extending from the lower end of the support post, the sleeve having an opening corresponding in shape to the cross-section of the support post, said sleeve having holes extending through opposite walls of the sleeve and being aligned perpendicular to the longitudinal axis of the support post;

a replaceable shear pin fastener extending through the holes in the sleeve, said replaceable shear pin fastener extending through the eye of the eyebolt to connect said support post to said foundation post, said replaceable shear pin fastener having a weakened portion which fractures upon exceeding to a predetermined lateral load on the support post when said support post receives an impact of sufficient force, said fracture of said replaceable shear pin fastener allowing said support post to separate from said foundation post.

2. The breakaway support structure of claim 1, further including a cable having loops on opposite ends, one loop being secured to said eyebolt the other loop being secured to the sleeve whereby said cable limits movement of said support post away from the foundation post.

3. In the breakaway support structure of claim 1, said sleeve having slots, and said two parallel legs of said U-shaped bracket being closely received in said slots to prevent rotation of said support post on said foundation.

* * * * *